US005252908A

United States Patent [19]

Brokaw

[11] Patent Number: 5,252,908

[45] Date of Patent: Oct. 12, 1993

[54] APPARATUS AND METHOD FOR TEMPERATURE-COMPENSATING ZENER DIODES HAVING EITHER POSITIVE OR NEGATIVE TEMPERATURE COEFFICIENTS

[75] Inventor: Adrian P. Brokaw, Burlington, Mass.

[73] Assignee: Analog Devices, Incorporated, Norwood, Mass.

[21] Appl. No.: 988,179

[22] Filed: Dec. 9, 1992

Related U.S. Application Data

[63] Continuation of Ser. No. 748,087, Aug. 21, 1991, abandoned.

[51] Int. Cl.[5] ..... G05F 3/18; G05F 3/20

[52] U.S. Cl. ..... 323/313; 323/231; 323/907

[58] Field of Search ..... 323/229, 231, 313, 314, 323/901, 907; 307/296.1, 296.6, 296.7, 310

[56] References Cited

U.S. PATENT DOCUMENTS

| | | | |
|---|---|---|---|
| 4,171,492 | 10/1979 | Burth | 323/231 |
| 4,313,083 | 1/1982 | Gilbert et al. | 323/231 |
| 4,622,512 | 11/1986 | Brokaw | 323/313 |
| 4,668,903 | 5/1987 | Elbert | 323/231 |
| 4,774,452 | 9/1988 | Ahmed | 323/231 |

FOREIGN PATENT DOCUMENTS

| | | | |
|---|---|---|---|
| 0220789 | 5/1987 | European Pat. Off. . | |
| 1484789 | 9/1977 | United Kingdom | 323/231 |
| WO85/01134 | 3/1985 | World Int. Prop. O. | 323/231 |

*Primary Examiner*—Steven L. Stephan
*Assistant Examiner*—Ben Davidson
*Attorney, Agent, or Firm*—Parmelee, Bollinger & Bramblett

[57] ABSTRACT

An auto-TC voltage reference wherein an operational amplifier receives at one input the voltage of a Zener diode and at its other input receives a compensation signal from a feedback circuit comprising a transistor and resistor network. When one of the resistors of the network is trimmed to give a nominal output voltage for the reference, the TC of the reference voltage will have been reduced to zero, or nearly so. The circuitry is capable of compensating Zener diodes of either positive or negative TC.

18 Claims, 4 Drawing Sheets

APPARATUS AND METHOD FOR TEMPERATURE-COMPENSATING ZENER DIODES HAVING EITHER POSITIVE OR NEGATIVE TEMPERATURE COEFFICIENTS

This application is a continuation of application Ser. No. 748,087 filed on Aug. 21, 1991 now abandoned.

BACKGROUND OF THE INVENTION

1. Field of the Invention

This invention relates to temperature-compensated Zener-diode voltage references. More particularly, this invention relates to a so-called "auto-TC" voltage reference wherein trimming of a circuit resistance to give a predetermined output voltage will simultaneously optimize the temperature compensation for that output voltage.

2. Description of the Prior Art

One type of "auto-TC" voltage reference has been described in U.S. Pat. No. 4,313,083. There a Zener diode voltage is applied to one input terminal of an operational amplifier and the other input terminal is supplied with a feedback voltage from a junction point in a series circuit comprising a pair of transistors with a pair of trimmable resistors. The bases of the two transistors are separately set to predetermined values by a three-resistor voltage divider between the output line and ground. The circuit disclosed can provide auto-TC compensation for Zener diodes having positive TC, but not for diodes having negative TC.

SUMMARY OF THE INVENTION

The present invention in one preferred embodiment provides an auto-TC voltage reference wherein an operational amplifier receives at one input the voltage of a Zener diode and at its other input receives a compensation signal from a feedback circuit comprising a transistor and resistor network. When one of the resistors of the network is trimmed to give a nominal output voltage for the reference, the TC of the reference voltage will have been reduced to zero, or nearly so. The circuitry is capable of compensating Zener diodes of either positive or negative TC.

DETAILED DESCRIPTION OF PREFERRED EMBODIMENTS

Figure 1:
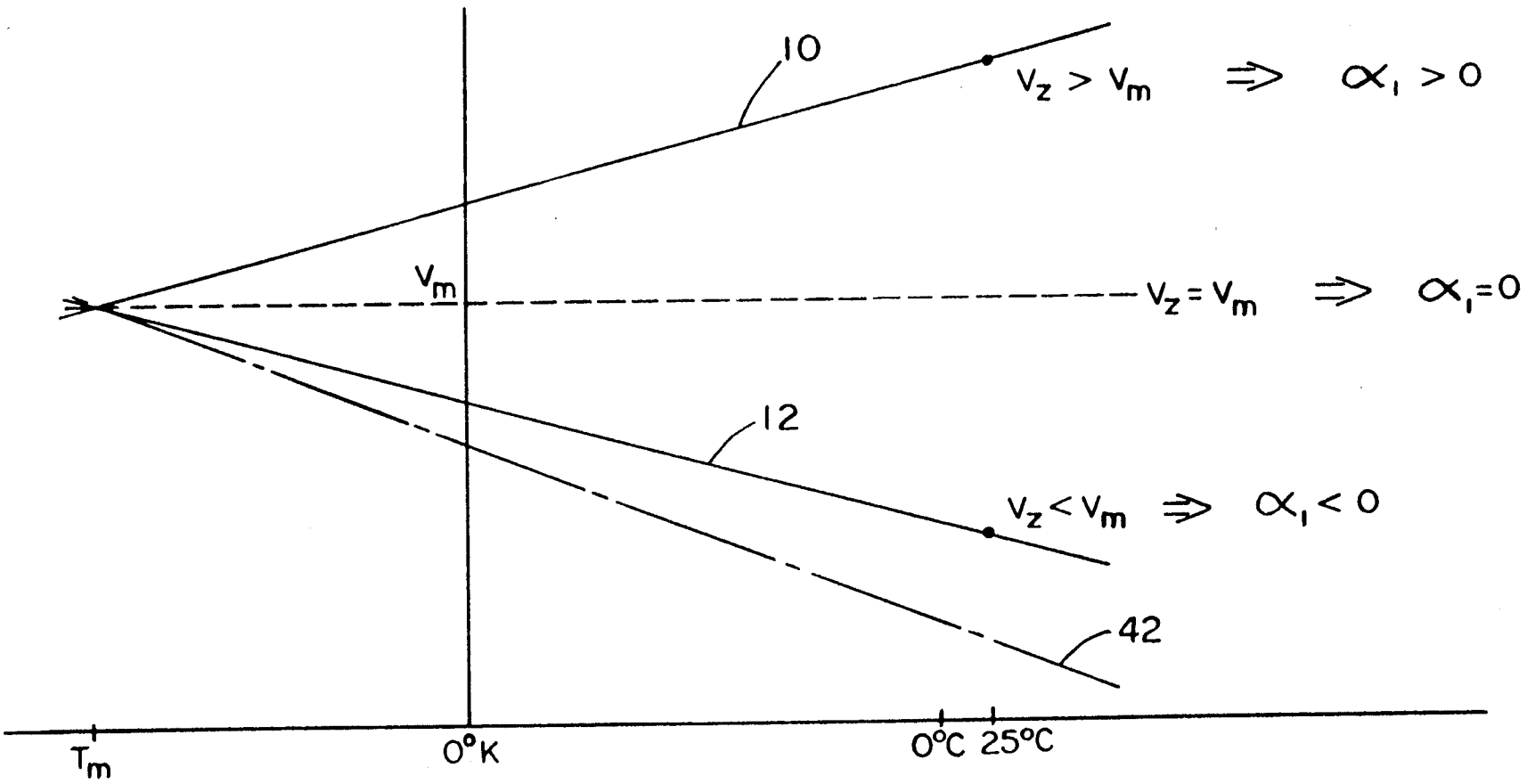
FIG. 1 is a graph showing the temperature-response characteristics of Zener diodes made by the same process.

The graph of FIG. 1 depicts in an idealized manner the temperature response characteristics of the avalanche voltage ($V_z$) versus temperature of a group of Zener diodes produced by the same process. The slopes of upper and lower solid lines 10 and 12 illustrate extremes of positive and negative temperature coefficients (TC) respectively. Any one diode made by the process can have a TC which lies anywhere between these extremes. It will be assumed in the following discussion that the temperature response characteristic is linear, which is approximately correct as a practical matter.

With Zener diodes made by the same process, it will be found that the temperature-response characteristic lines for all diodes will (at least approximately) pass through the same voltage point $V_m$ at a temperature of $T_m$, as shown in FIG. 1. $T_m$ is shown as being negative on the absolute or Kelvin scale, which is generally true in practice. Although such a negative $T_m$ is not a realizable operating point, it is useful for analysis as an extrapolation of Zener behavior in a normal operating temperature range.

It will be seen from FIG. 1 that the avalanche voltage of the Zener diodes can be described by:

$$V_z = V_m + \alpha_1 (T - T_m)$$

where:

$V_z$ is the avalanche voltage, $V_m$ is a voltage parameter which is relatively insensitive to variations in a given process (and typically is in the range of 4.4 V to 4.8 V for a number of known processes), $T_m$ is a temperature parameter which is relatively insensitive to variations in a given process, and $\alpha_1$ is a parameter with a value associated with each fabricated device. Its variability from unit to unit encompasses most of the avalanche voltage variations which result from process variability.

Figure 2:
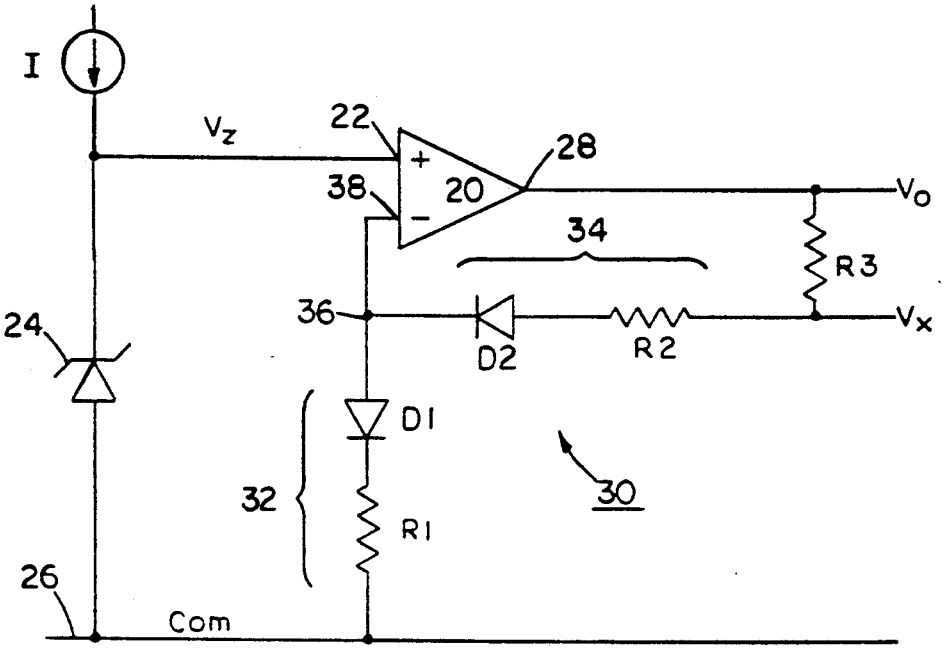
FIG. 2 is a schematic to illustrate the functioning of a voltage reference in accordance with the invention.

Referring now to FIG. 2, there is shown a circuit for illustrating aspects of the present invention. This circuit includes an operational amplifier 20 having its non-inverting input terminal 22 connected to the positive electrode of a Zener diode 24 producing a voltage $V_z$. The other Zener electrode is connected to a common line 26. The Zener voltage generally is temperature sensitive, as discussed above with reference to FIG. 1.

The output terminal 28 of the amplifier 20 produces an output voltage $V_o$ responsive to the applied Zener voltage. A negative feedback circuit generally indicated at 30 is connected between the output terminal 28 and the common line 26.

This feedback circuit 30 includes a number of series-connected elements comprising a first segment 32 with a resistor R1 and diode D1, a second segment 34 with a resistor R2 and a diode D2, and a resistor R3. The junction point 36 between the two segments 32, 34 is connected to the inverting input terminal 38 of the amplifier 20.

In considering the operation of this circuit, let it be assumed first that R1=R2, that R3=0, and that the diodes D1, D2 are matched. The voltage across the first segment 32 (i.e., at the amplifier input terminal 38) will be essentially $V_z$, due to feedback action. Since R1 and R2 are equal, and carry equal currents, the voltage $V_x$ at the right-hand end of R2 (and at the output terminal 28) will be twice $V_z$. This relationship will hold true regardless of changes in temperature.

If the Zener diode 24 has a zero TC (rare, but possible), the output $V_o$ will be temperature invariant. However, because there is a diode in each feedback segment 32, 34, and because the $V_{BE}$ of a diode has a negative TC, the current in the feedback circuit nevertheless will vary with temperature.

With a Zener diode 24 having a negative TC ($\alpha_1<0$), the voltage $V_z$ at the amplifier input terminals 22 and 38 will decrease with increasing temperature as will the output voltage $V_o$. Assuming that the $V_{BE}$ of diode D1 has a TC which is more negative than the negative TC of $V_z$, the current through the feedback resistor R1 (and thus through R2) will have a positive TC. This is because the temperature-induced negative change in $V_{BE}$ of diode D1 with increasing temperature will be greater than the negative change in Zener voltage $V_z$, so that the net voltage across R1 will increase with temperature, as will the current through R1 (and R2).

If R3 now is made greater than zero (R3>0), the output $V_o$ will increase due to the added voltage drop across R3 resulting from the feedback current. This added increment to the output voltage will have a positive TC (since the feedback current will in the circumstances noted above have a positive TC). By adjusting the value of R3, the positive TC of the voltage across R3 can compensate for the negative TC of the Zener voltage $V_z$, so that the output $V_o$ can be made (essentially) invariant with temperature.

The same circuit can be used to provide similar compensation for Zeners with a positive TC. In this case, rather than making R3>0, the value of R2 will be reduced. In effect, R3 will be made "negative" (although of course a negative resistance is not actually present in the circuit). The result will be that $V_o$ is reduced (since the voltage drop across a reduced R2 is correspondingly reduced), and the TC of the voltage across "negative" R3 will be negative, thus compensating for the positive TC of the Zener.

The value of R3 thus can with advantage be viewed as an incremental deviation ($\pm\Delta R$) from the nominal value of R2 where R2=R1. To provide for a practical trimming sequence, the initial value of R2 can be set significantly less than R1 (R2<<R1), and R2 can be thought of as R2 "nominal" in series with an initially negative R3 of relatively large value. The circuit without any trimming should be capable of compensating for a limiting (maximum) positive TC in the Zener 24. Since the actual Zener normally will have a less positive TC than this limiting value, R2 can be trimmed up (increased in ohmic value) until the correct magnitude is reached to provide compensation for the actual Zener involved (including Zeners with negative TC).

The range of Zener TC which can be compensated is constrained by the relationship between the diode $V_{BE}$ and the magnitude of the Zener voltage $V_z$ which determines the maximum TC of the current in R1 and R2. To increase this range, more diodes can be added to both feedback segments 32, 34.

In determining the number of diodes in each feedback segment 32, 34, it may turn out that the desired number of diode drops in each may not be an integer. Fractional values of $V_{BE}$ can be achieved and the circuit simplified (at least in the number of junctions required) by using a "$V_{BE}$ multiplier" of known configuration, as shown at 40 in FIG. 3 (and also as described in Brokaw U.S. Pat. No. 4,622,512). The $V_{BE}$ of transistor Q4 appears across resistor R6, and the accompanying current through R6, R5 and R4 produces a multiplied version of that $V_{BE}$ across resistors R5 and R4.

The feedback voltage for input terminal 38 is tapped off an intermediate point 36A between R4 and R5. Thus the $V_{BE}$ of one transistor can be "multiplied" to provide effective junction drops in both feedback segments 32A and 34A. Here the $V_{BE}$ is effectively multiplied by (1+(R4+R5)/R6), and this multiplied voltage is divided between the lower and upper segments in proportions determined by the resistance values.

One limitation of the FIG. 2 arrangement is that the output voltage $V_o$ will always be at or near $2V_z$. To accommodate a larger range of values for the output voltage, a modification as illustrated in general form in FIG. 4 can be employed. This configuration uses a feedback circuit 30B where the elements in the second segment 34B have values "k" times the values of the corresponding elements in the lower segment 32B (with k being a preselected constant). Thus the diode drop in the upper segment is $kV_c$, and the series resistor R2=kR1. The output voltage then will be $V_o=V_z(1+k)$, for the nominal case where $\alpha_1=0$ and $V_z=V_m$. This FIG. 4 relationship can be established in the FIG. 3 feedback arrangement by appropriately-sized feedback resistors.

By selection of circuit values, $V_o$ can be made a convenient value higher than $V_m$. In the case of an auto-TC design (referred to above in the section on prior art and as described in more detail below), the nominal value of $V_o$ to which the output will be trimmed must be higher than the maximum anticipated Zener voltage by an amount which allows for the temperature compensation voltage.

It may particularly be noted that for negative values of $\alpha_1$, trimming to increase the output TC will increase the output voltage $V_o$. Conversely, for positive $\alpha_1$, trimming to decrease the output TC (by making R2<kR1) will lower the output voltage $V_o$. Thus the direction of voltage change is correct for providing an auto-TC compensation. To achieve that result, it is necessary to establish correct proportions between the output voltage adjustment (change in $V_o$), and the induced TC.

Considering the auto-TC design further, the desired nominal output voltage $V_o$ should first be chosen. This number can be somewhat arbitrary, but must be within practical constraints. It must for example be comfortably higher than the nominal Zener voltage $V_m$, and it must be within power supply voltage limitations. As an illustration, one might select $V_o$=6 volts. To provide a practical example, and with reference to the $V_{BE}$-multiplier arrangement of FIG. 3, the feedback resistors in one circuit were as follows:

R1=7K
R2=200 (initially)
R4=16.17K
R5=34.39K
R6=15K

Taking the case where the Zener diode produced a voltage $V_m$=4.52 V at a temperature $T_m$ of −350° C. (−78° K.), and assuming that the Zener TC is a positive $\alpha_1$=1 volt/°C., was found that for the above simulated circuit a 6 V output at 27° C. (room temperature) occurred when R2 was trimmed up to 694Ω. A subsequent temperature sweep of 180° about room temperature (i.e., above and below room temperature) resulted in a change in "Zener voltage" of about 360 mV. The output voltage $V_o$ changed only about 4 millivolts peak-to-peak, in a convex curve centered roughly about 6 volts, with the output lower than 6 V at both ends of the curve. For a simulated Zener with a negative TC of −1/°C., a $V_o$ of 6 volts at room temperature was obtained when R2 was trimmed to 4.56K. The output changed by only about 5 mV peak-to-peak over the same 180° temperature sweep, in a curve which was inverted relative to the positive TC Zener curve.

In both cases, the value of R2 which made $V_o=V_m(1+k)$ also resulted in zero TC (or nearly so), thus providing the desired auto-TC feature. Moreover, the circuit provided auto-TC for Zener diodes with either positive or negative TC.

With regard to providing an auto-TC feature, it may be noted that R1 can be chosen to give any nominal current through the feedback network at a given temperature. Since $V_c$ has a TC proportional to its value, the TC of the current can be adjusted by adjusting $V_C$. Thus it is possible to independently choose the current and the TC of the current, over some range. This is what makes it possible to find a single value of R3 which compensates both the TC of $V_o$ to zero (or nearly so) and simultaneously sets the output voltage at $(1+k)V_m$.

To see what value of $V_c$ will achieve this condition, first consider the case where the Zener has a voltage $V_m$ and zero TC. In this case, it will not be necessary to adjust R3 away from zero, the feedback ratio will be $(1+k)$ at all temperatures, and both $V_x$ and $V_o$ will equal $(1+k)V_m$.

If a Zener with a negative TC now is substituted so that the output $V_o$ at room-temperature is lower, it will be necessary to increase R3 to bring $V_o$ up to the desired $(1+k)V_m$ and to give it a zero TC, assuming that $V_c$ has been chosen properly to give auto-TC. Then, at the trimming temperature, the feedback ratio from the amplifier output will differ from $1+k$. As temperature changes, the resulting change in proportions of resistor voltage to voltage source (diode drops) in the feedback network will adjust the feedback ratio to keep $V_o$ constant in the face of changing $V_z$.

If it is imagined that the temperature is changed to $T_m$ (even though physically it might not be possible to do so), the voltage of the Zener should change to $V_m$, since the characteristic temperature response lines of all Zeners pass through this point (FIG. 1). If R3 has been properly adjusted in the feedback, $V_o$ should be at $(1+k)V_m$ at any temperature, including $T_m$. However, if R3 is not zero, the ratio of the resistive parts of the feedback would not be $(1+k)$, although the voltage source component ratio always is.

The only way that these conditions can be satisfied simultaneously is if the current in the feedback resistors is zero at the imagined condition where $T=T_m$, so that the resistors' contribution to the feedback voltage ratio is zero. This requirement will be satisfied if $V_c=V_m$ at $T_m$. This means that the temperature-response characteristic of $V_c$ is a straight line (assuming linear relations) having a negative TC and passing through the voltage $V_m$ at temperature $T_m$. This is illustrated by the interrupted line 42 in FIG. 1.

It is possible to construct a voltage source the behavior of which at circuit temperatures extrapolates to this required behavior at $T_m$. First, it is noted that a transistor $V_{BE}$ has a negative TC and its voltage extrapolates to go through the bandgap voltage (approximately 1.2 V) at 0° K. Choosing $V_c$ to be a multiple of $V_{BE}$ makes it possible to develop such a voltage which extrapolates to $V_m$ at $T_m$. Using k times this multiple of $V_{BE}$ as the voltage source in the upper segment 34B of the feedback completes the compensation so that trimming R3 to bring $V_o$ to $(1+k)V_m$ should also cause the TC of $V_o$ to be zero.

Figure 3:
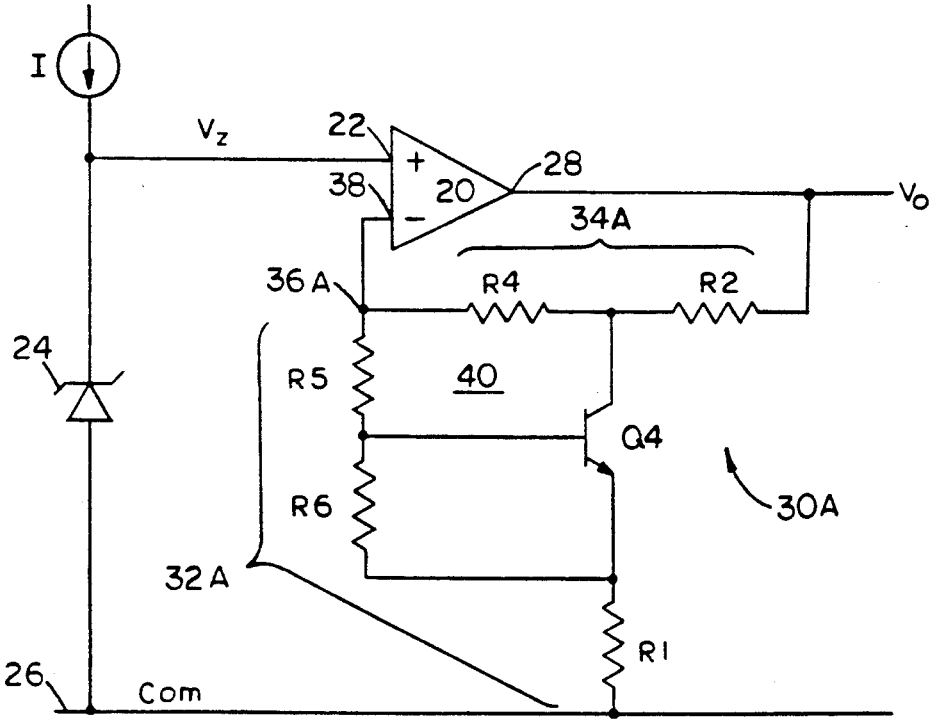
FIG. 3 shows a modified circuit based on FIG. 2 but utilizing only a single transistor in the feedback network.

The FIG. 3 configuration, the magnitude of $V_c$ is set by the values of the resistors in the feedback network. In the example given above, where $V_m=4.52$ V, it is necessary to select the resistors so that the value of $V_c$ at room temperature will, when extrapolated back to $T_m$ (assuming, as always in this analysis, linear relationships) be 4.52 V. In the FIG. 3 circuit, the value $V_c=4.52$ V will be represented by the voltage across R5 and R6 (it being noted that at the temperature $T_m$ with $V_c=V_m$ there will be no current through any of the feedback resistors). The total voltage across all three feedback resistors R4, R5 and R6 similarly will be 6 V, since that is the selected output voltage. Thus the resistance ratio (R5+R6)/R4 will be as follows:

$$\frac{R5+R6}{R4}=\frac{4.52}{6-4.52}\approx 3.04$$

It will be seen that the $V_{BE}$ multiplier should produce a total of about 4 $V_{BE}$s, with one $V_{BE}$ across R6, about two $V_{BE}$s across R5, and about one $V_{BE}$ across R4.

Now considering the conditions at room temperature, with R2 adjusted to provide an output $V_o$ with zero TC at an output $V_o$ of 6 V, just as it was when the temperature was imagined to be at $T_m$, except that now current will be flowing through the feedback resistors. Since the $V_{BE}$ multiplier voltage ratio of the two segments 32A, 34A is to be the same at room temperature as when at temperature $T_m$, the ratios of resistors R1 and R2 must conform to the previously determined ratio of resistors R5+R6 to R4 in order that the output be 6 V. That is: R2/R1=(6−4.52)/4.52. If R1 is set at 7K for practical reasons, then R2 (nominal) will be about 2.3K, for the nominal case when the Zener TC=0. (Of course, the initial value of R2 will be much less, say about 200Ω, in order that it can be trimmed in one direction to cover all of the possible Zener characteristics from positive to negative TCs.)

Having determined the conditions for two operating points ($T=T_m$; T=room temperature) for an output of 6 V with zero TC, it will be seen that the output $V_o$ must also be 6 V, with zero TC, at all other operating points. This is because the characteristics of all of the elements in the circuit have been assumed to be linear, so that their summation or differencing must also be a linear relationship.

Figure 4:
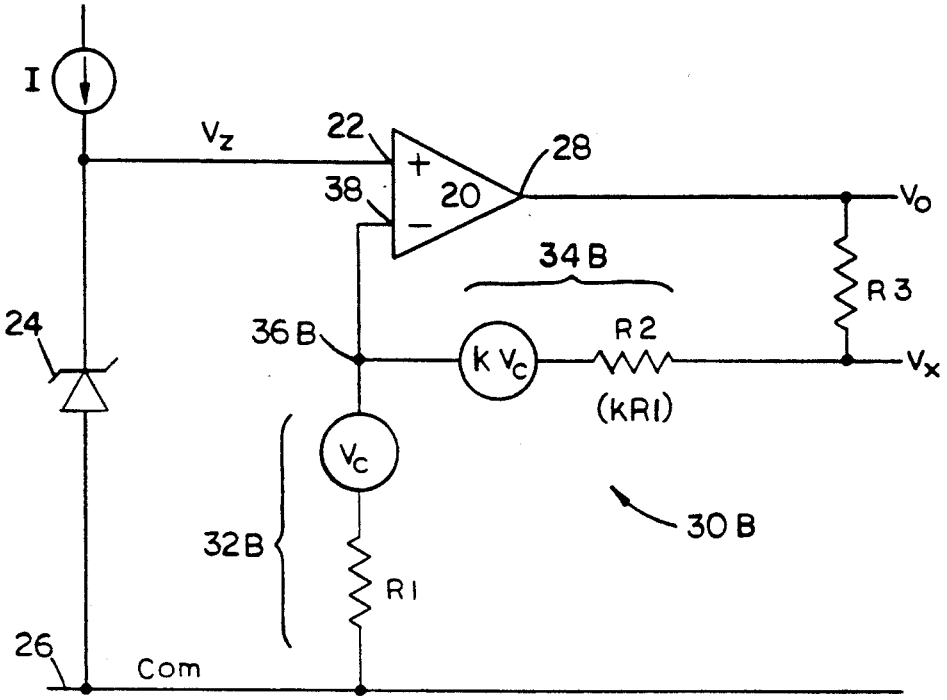
FIG. 4 presents a generalized schematic diagram to illustrate further aspects of the invention.

To provide a more detailed mathematical explanation of these relationships, the following is presented with reference to FIG. 4:

$$\begin{aligned} V_o &= V_x + V_3 \\ V_o &= (V_m + \alpha_1(T-T_m)(1+k) + \\ &\quad (R3/R1)(\alpha_1-\alpha_2)(T-T_m) \\ &= V_m(1+k) = \alpha_1(T-T_m)(1+k) + \\ &\quad (R3/R1)(\alpha_1-\alpha_2)(T-T_m) \end{aligned}$$

(where $\alpha_2$ is the temperature coefficient of $V_c$)

The first term of this expression is the same as the nominal value of $V_o$ for which the circuit is intended. To get $V_o$ to the nominal value, R3 must be adjusted to make the remaining terms zero.

$$\alpha_1(T-T_m)(1+k)+(R3/R1)(\alpha_1-\alpha_2)(T-T_m)=0$$

The temperature dependence can be divided out with the factor $(T-T_m)$ to give:

$$\alpha_1(1+k)+(R3/R1)(\alpha_1-\alpha_2)=0$$
$$(R3/R1)(\alpha_2-\alpha_1)=\alpha_1(1+k)$$
$$R3=R1(1+k)\alpha_1/(\alpha_2-\alpha_1)$$

This value of R3 should cause $V_o=V_m(1+k)=V_o$ (nominal) at all temperatures.

There are practical constraints however. $V_c$ is not a battery, but something constructed of forward-biased diode drops. Therefore, it must have some bias current to operate which implies that the voltage across R1 must be positive for all operating temperatures and bias conditions. Presumably $T-T_m$ will always be positive, since $T_m$ is often less than 0° Kelvin. Therefore the constraint that $(\alpha_1-\alpha_2)(T-T_m)>0$ requires that $\alpha_1-\alpha_2>0$ or $\alpha_1>\alpha_2$. Since it is desired to accommodate a range of $\alpha_1$ which may be positive or negative, $\alpha_2$ must be made more negative than the most negative value of $\alpha_1$. That is, the TC of the compensating voltage must be more negative than the most negative Zener TC expected from the process.

Another constraint arises from the nature of R3. In practice, R3 can be made large by trimming R2 well beyond its nominal value R2=kR1. It cannot be made more negative than the value of R2, however, since negative values of R3 are realized in practice by leaving R2 trimmed below its nominal value. Therefore:

$$R3>-R2$$

Substituting R2/k=R1 in the expression for R3 gives:

$$R2((1/k)+b\ 1)\alpha_1/(\alpha_2-\alpha_1)>-R2$$

Since R2 is always positive it may be divided out, and multiplying through by −1 will reverse the inequality and change the denominator to give:

$$(\alpha_1/k+\alpha_1)/(\alpha_1-\alpha_2)<1$$
$$\text{Since } \alpha_1-\alpha_2>0$$
$$\alpha_1/k+\alpha_1<\alpha_1-\alpha_2$$
$$\alpha_1/k<-\alpha_2$$

Since $\alpha_2$ is negative, $-\alpha_2$ will be positive, and assuming k is always positive $k>\alpha_1/(-\alpha_2)$ Since the denominator of the right side is positive, k will be constrained when $\alpha_1$ is positive. For example, if the largest anticipated Zener TC $\alpha_1(\max)=+2$ mV/°C. and $\alpha_2=-6$ mV/°C., then $k>\frac{1}{3}$.

With reference to FIG. 3, the base emitter voltage of the transistor will fall more-or-less linearly with temperature according to the relation:

$$V_{BE}=V_{GO}-\frac{T}{To}(V_{GO}-V_{BEO})+\frac{kT}{q}\ln\frac{I}{I_o}+\frac{mkT}{q}\ln\frac{To}{T}$$

The largest component of this expression is the second term which is linear in T. The third term usually reduces the effect of the fourth term, although the circuit described here does not force a strictly PTAT collector current as is often done in bandgap circuits.

Common practice, in uncorrected bandgap circuits, is to extrapolate $V_{BE}$ back towards zero using a tangent to the curve at the center of the temperature range. This results in a 0 Kelvin voltage slightly higher than $V_{GO}$, but the number is useful in a linearized approximation to behavior of $V_{BE}$ vs. temperature.

In the auto-TC circuit disclosed herein, it is necessary to extrapolate the behavior of $V_{BE}$ back to $T_m$, the Zener temperature parameter. Using the design temperature value of $V_{BE}$ and the TC at this temperature (or the slope inferred from $V_{BE}$ and the 0 Kelvin extrapolation as otherwise determined), an extrapolated voltage for $V_{BE}$ at $T_m$ can be calculated. Denoting this value $V_E$, the ratio of $V_m$ to $V_E$ will determine the "number" of $V_{BE}$s to be produced across R5 and R6. The value of R6 can be selected from biasing considerations by determining how much of the total current in R1 can be diverted to R4, R5 and R6. Then, R5=R6 $((V_m/V_E)-1)$. This will cause the voltage across R5 and R6 to approximate the function $V_m+\alpha_2(T-T_m)$ where $\alpha_2$ is a multiple of the design temperature TC of $V_{BE}$. An error will result from the base current of the transistor Q4, but this will generally be small. If low $\beta$ is a problem, the error can be reduced by using an integral number of diode connected transistors less than $V_m/V_E$, and multiplying only one to get any fractional part (see FIG. 6).

The proper upper segment compensating voltage $kV_c$ can be produced by making R4=k(R5+R6), for the value of k selected to fit the design goals and previous constraints.

Again a mix of diodes and one multiplied $V_{BE}$ can reduce base current error. Given the nominal $V_{BE}$ and its multiplied value, the nominal voltage across R1 can be calculated based on expected Zener voltage. This voltage together with the selected operating current for the $V_{BE}$ multiplier determines R1. The nominal value of R2 is kR1; however, the actual value to use will depend on the expected negative values calculated for R3. Its trim range will then depend on the positive values for R3.

The circuit also can be analyzed by holding R2 constant (R3=0). It will be found from such analysis that the circuit can be trimmed by adjusting R1.

Figure 5:
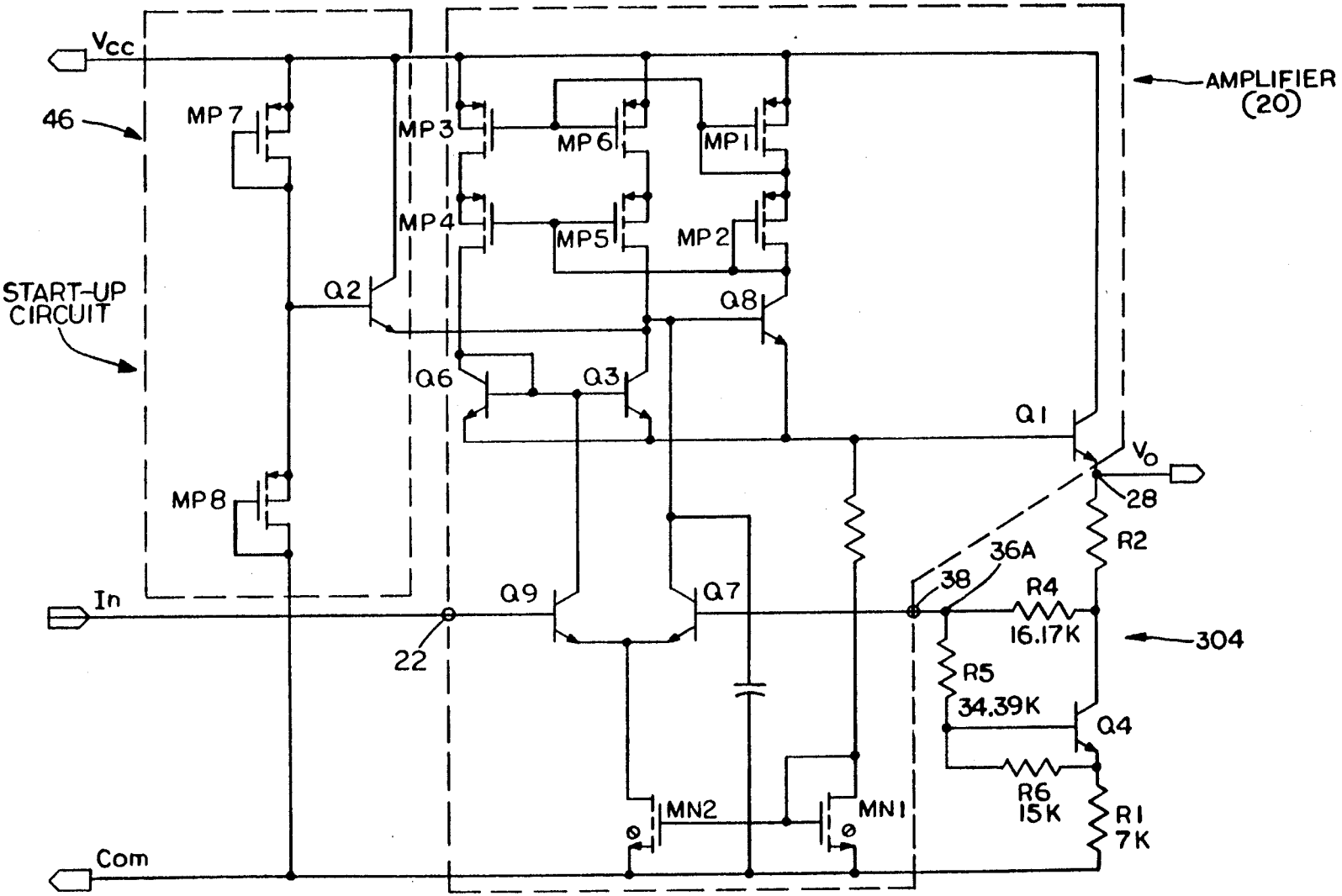
FIG. 5 is a circuit diagram showing a circuit design suitable for an integrated circuit.

FIG. 5 presents a detailed circuit diagram of a voltage reference in accordance with this invention and suitable for adaptation to IC format. A dashed-line box 20 indicates the operational amplifier, as shown in the somewhat simplified diagrams previously discussed. The feedback circuit 30A is of the $V_{BE}$-multiplier type described with reference to FIG. 3. A start-up circuit 46 is provided in the usual way.

Figure 6:
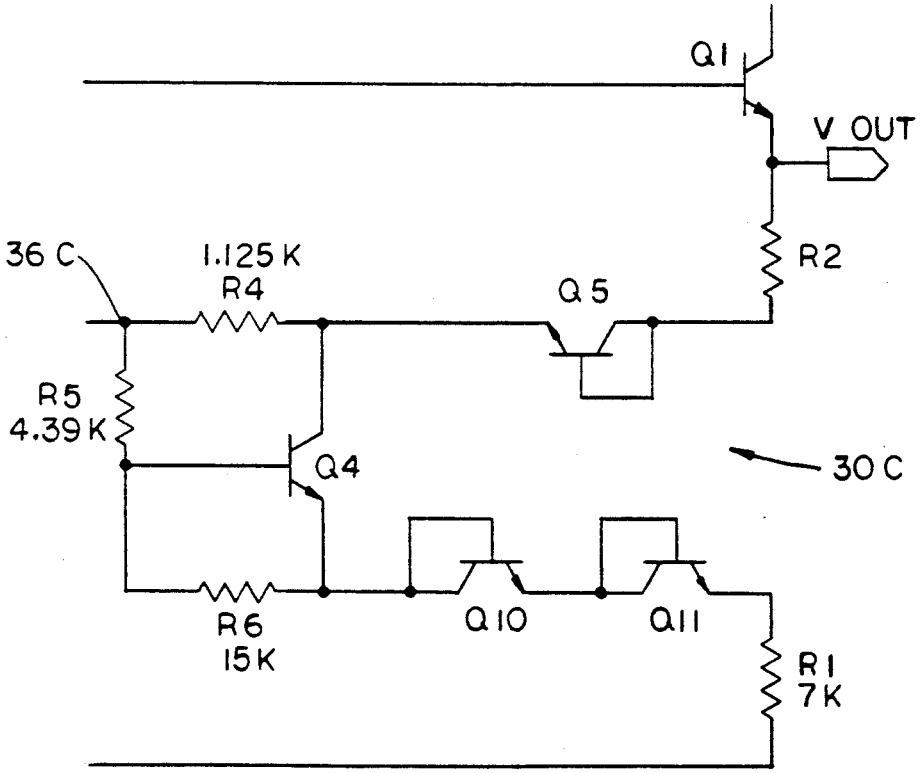
FIG. 6 is a circuit diagram showing a modification to the circuit of FIG. 5.

FIG. 6 presents a modified form of feedback circuit 30C for the voltage reference of FIG. 5, to reduce errors due to base current in the $V_{BE}$ multiplier transistor Q4. In this modification a pair of diode-connected transistors Q10 and Q11 have been connected in series with the transistor Q4 to produce the required integral number of $V_{BE}$s, with the fractional part for the lower feedback segment being supplied by the $V_{BE}$ multiplier across R5. Similarly, an additional transistor-connected diode Q5 has been inserted between R4 and R2 with the fractional part of $V_{BE}$ for the upper segment appearing across R4. The voltage between the network junction point 36C and the top of R1 will be about $3\frac{1}{3}$ $V_{BE}$s. With this circuit the required extrapolated value for $V_{BE}$ can be obtained with a smaller total resistance in the multiplier portion of the circuitry (i.e., R4 and R5), so the base current of Q4 will flow through a smaller resistance (R4), and thus cause less voltage error due to base current.

Although several preferred embodiments of the invention have been disclosed herein in detail, it is to be understood that this is for the purpose of illustrating the invention, and should not be construed as necessarily limiting the scope of the invention since it is apparent that many changes can be made by those skilled in the art while still practicing the invention claimed herein.

What is claimed is:

1. A temperature-compensated Zener-diode voltage reference for a class of Zener diodes having temperature characteristics with a common intersection at particular temperature and voltage levels, said reference comprising:

an amplifier having input means and an output circuit for producing a reference voltage;

a Zener diode producing a temperature-responsive voltage;

means connecting one terminal of said Zener diode to said amplifier input means and the other diode terminal to circuit common;

a feedback network coupled between said output circuit and said circuit common, said network carrying a feedback current derived at least substantially from said output circuit;

said feedback network comprising first and second serial segments;

means connecting an intermediate point between said serial segments to said input means to furnish thereto a feedback signal representing voltage across said first serial segment, said feedback signal being made equal to the Zener diode voltage supplied to said input means;

each of said segments including at least one resistive means;

said first segment further including means to produce a temperature-responsive voltage;

said temperature-responsive voltage and said Zener diode voltage at said intermediate point together controlling the magnitude of feedback current through the resistive means of said first segment;

said feedback current flowing also through the resistive means of said second segment;

the values of said resistive elements being set to effect temperature compensation of the voltage produced by said output circuit so as to reduce changes in said reference voltage resulting from variations in said Zener voltage with temperature.

2. A temperature-compensated Zener-diode voltage reference as claimed in claim 1, wherein the temperature-responsive voltage means of said first segment is sized to be equal to said particular voltage level when extrapolated to said particular temperature.

3. A temperature-compensated Zener-diode voltage reference as claimed in claim 1, wherein the temperature-coefficient of said temperature-responsive means of said first segment is more negative than the most negative temperature coefficient expected from said class of Zener diodes.

4. A temperature-compensated Zener-diode voltage reference as claimed in claim 1, wherein said feedback network comprises a bipolar transistor with a $V_{BE}$ multiplier circuit so arranged that a first part of the total $V_{BE}$ voltage is effectively in said first segment and a second part is effectively in said second segment.

5. A temperature-compensated Zener-diode voltage reference as claimed in claim 4, including at least one series diode connected in said first segment to provide for reduced resistances in said $V_{BE}$ multiplier circuit so as to reduce errors due to the base current of said transistor.

6. A temperature-compensated Zener-diode voltage reference as claimed in claim 1, wherein the resistive element in said second segment is trimmable to adjust the reference voltage to a predetermined nominal level while optimizing the temperature compensation of said reference voltage.

7. A temperature-compensated voltage reference for use with a class of Zener diodes made by a single process, said voltage reference comprising:

an amplifier having input means and an output circuit for producing a reference voltage;

a Zener diode of said class connected to said amplifier input means;

a feedback network coupled to said output circuit;

said feedback network comprising first and second serial segments;

means connecting an intermediate point between said serial segments to said input means to furnish thereto a feedback signal representing the voltage across said first voltage segment, said feedback signal being made equal to the Zener diode voltage supplied to said input means;

said first and second segments respectively including first and second resistance means together with associated temperature-responsive voltage-producing means to develop temperature-responsive voltages in both of said segments;

the current in said first segment resistance means being set jointly in accordance with said Zener diode voltage and the temperature-responsive voltage associated with said first segment;

said current of said first segment flowing also through said resistance means of said second segment to produce a corresponding voltage drop thereacross;

the magnitude of the voltage produced in said second segment being predeterminedly proportional to the magnitude of the voltage produced in said first segment;

the values of said first and second resistance means being set to produce a predetermined nominal reference voltage and simultaneously to effect temperature compensation of that reference voltage.

8. A temperature-compensated voltage reference as claimed in claim 7, wherein said feedback network comprises a bipolar transistor connected in a $V_{BE}$ multiplier circuit;

a part of the total voltage of said multiplier circuit being coupled into said first segment and another part of said total voltage being coupled into said second segment.

9. A temperature-compensated voltage reference as claimed in claim 7, wherein the nominal values of said second segment resistance and the voltage of the second segment voltage-producing means are sized to be $(1+k)$ times the first segment resistance and the voltage of the first segment voltage-producing means, where "k" is a preselected constant.

10. The method of temperature-compensating the voltage of a Zener diode of a class of diodes made by a single process and which may have either a positive or a negative temperature coefficient, said method comprising:

directing the Zener voltage to the input of an amplifier producing a corresponding output voltage to develop a reference voltage;

developing a negative feedback current in a serially-connected two-segment feedback network connected between the amplifier output and a circuit node wherein the first segment includes first resistance means and first temperature-responsive voltage means connected to said circuit node and the second segment includes second resistance means and second temperature-responsive voltage means connected to said amplifier output;

connecting to said amplifier input a feedback voltage developed at an intermediate point of said feedback network between said segments by feedback current flowing from said output circuit through said segments, said feedback voltage being made equal to said Zener voltage by feedback action;

the feedback current in said first segment being proportional to the difference between said Zener voltage and the voltage produced by said first temperature-responsive voltage means; and directing said feedback current of said first segment to pass through said resistance means of said second segment to produce a temperature-responsive voltage drop across said second resistance means.

11. The method of temperature-compensating the voltage of a Zener diode as claimed in claim 10, including the step of trimming one of said resistance means to fix said output voltage at a preselected level.

12. The method of temperature-compensating the voltage of a Zener diode as claimed in claim 11, including the step of trimming said one resistance means to produce a predetermined output voltage level and simultaneously effect optimal temperature compensation of that output voltage.

13. The method of temperature-compensating the voltage of a Zener diode as claimed in claim 12, wherein the resistance means in said second segment is trimmed to produce said predetermined output voltage level.

14. The method of temperature-compensating the voltage of a Zener diode as claimed in claim 10, wherein said class of diodes have temperature-responsive voltage characteristics all of which pass through a specific voltage at a specific temperature;

sizing the magnitude of said temperature-responsive voltage means in said first segment to a value which when extrapolated back to said specific temperature, will be equal to said specific voltage.

15. The method of temperature-compensating the voltage of a Zener diode comprising:

directing to the input of an amplifier a voltage derived from the Zener diode voltage, said amplifier having an output circuit producing an output voltage to develop a reference voltage;

developing a negative feedback current in a serially-connected multi-segment feedback network connected between said amplifier output circuit and a circuit node wherein one segment includes first resistance means and first temperature-responsive voltage means producing a first temperature-responsive voltage, and a second segment includes second resistance means;

directing to said amplifier input a feedback voltage developed at an intermediate point of said feedback network between said one segment and said second segment, said feedback voltage being made equal to the amplifier input voltage from said Zener voltage by feedback action;

controlling a feedback current component in said first resistance means jointly in accordance with said Zener diode voltage and said first temperature-responsive voltage; and directing through said second resistance means a current proportional to said controlled feedback current of said one segment to produce a corresponding voltage drop across said second resistance means.

16. The method of claim 15 wherein said feedback current of said one segment is controlled to be proportional to the difference between said Zener diode voltage and said first temperature-responsive voltage.

17. The method of claim 15 wherein said negative feedback current is derived at least substantially from said amplifier output circuit.

18. The method of temperature-compensating the voltage of a Zener diode comprising:

directing to the input of an amplifier a voltage derived from the Zener diode voltage, said amplifier having an output circuit producing an output voltage to develop a reference voltage;

developing a negative feedback current in a serially-connected multi-segment feedback network connected between said amplifier output circuit and a circuit node wherein one segment includes first resistance means and first temperature-responsive voltage means producing a first temperature-responsive voltage, and a second segment includes second resistance means;

deriving said negative feedback current at least substantially entirely from said amplifier output circuit;

directing to said amplifier input a feedback voltage developed at an intermediate point of said feedback network between said one segment and said second segment;

controlling said feedback current in said first resistance means to be temperature-responsive voltage for temperature-compensating said amplifier output voltage; and controlling said feedback current through said second resistance means to be proportional to said controlled feedback current of said one segment to produce a corresponding voltage drop across said second resistance means.

* * * * *